United States Patent [19]

Alsch

[11] Patent Number: 5,055,644

[45] Date of Patent: Oct. 8, 1991

[54] SNAP LOCKING MECHANISM FOR ROTARY ELECTRICAL SWITCHES

[75] Inventor: Gottfried Alsch, Vienna, Austria

[73] Assignee: Hubert L. Naimer, Ascona, Switzerland

[21] Appl. No.: 503,447

[22] Filed: Apr. 3, 1990

[30] Foreign Application Priority Data

May 24, 1989 [AT] Austria ..... 1268/89

[51] Int. Cl.[5] ..... H01H 3/20

[52] U.S. Cl. ..... 200/325; 200/327; 200/336; 74/142

[58] Field of Search ..... 200/323, 324, 325, 327, 200/336, 17 B, 416, 419, 421, 526, 527, 528; 74/141.5, 142, 145, 99 R, 99 A

[56] References Cited

U.S. PATENT DOCUMENTS

| | | | |
|---|---|---|---|
| 2,810,029 | 10/1957 | Hutt | 200/419 |
| 3,718,786 | 2/1973 | Fila | 200/419 |
| 3,770,926 | 11/1973 | Wanner | 200/336 X |
| 4,175,220 | 11/1979 | Johnston et al. | 200/325 X |
| 4,263,486 | 4/1981 | Taylor | 200/336 X |
| 4,737,608 | 4/1988 | Jones | 200/336 X |

FOREIGN PATENT DOCUMENTS 374960 6/1984 Austria .

*Primary Examiner*—Henry J. Recla

*Assistant Examiner*—Glenn T. Barrett

*Attorney, Agent, or Firm*—Nixon & Vanderhye

[57] ABSTRACT

In a snap locking mechanism for rotary switches an operating shaft (4) operable by a switch handle can be rotated against the force of an energy-storage mechanism and each lock-in position is occupied with at least partial release of the energy-storage mechanism. The energy-storage mechanism is formed by axially acting compression springs (8) and acts on a driver ring (6) exhibiting slopes in the peripheral direction which interacts with another driver ring (13), couplable with the operating shaft, exhibiting a corresponding counterprofile with slopes. A coupling for dragged slaving (28, 29) is provided between the two driver rings (6, 13). Handle-side driver ring (6) carries stops (11) on its front facing away from these slopes, which interact with counterstops (12), integral with the housing, when they reach the snap position of the locking mechanism.

Two annular links (14, 15) placed concentrically to the slopes of driver rings (6,13), each of which is operative for one direction of rotation each and which exhibit on their front sawteeth inclined in the opposite direction to one another running in the peripheral direction and which interact respectively with a corresponding counterprofile on handle-side driver ring (6) or in housing (2) (FIG. 1).

17 Claims, 5 Drawing Sheets

SNAP LOCKING MECHANISM FOR ROTARY ELECTRICAL SWITCHES

Figure 1:
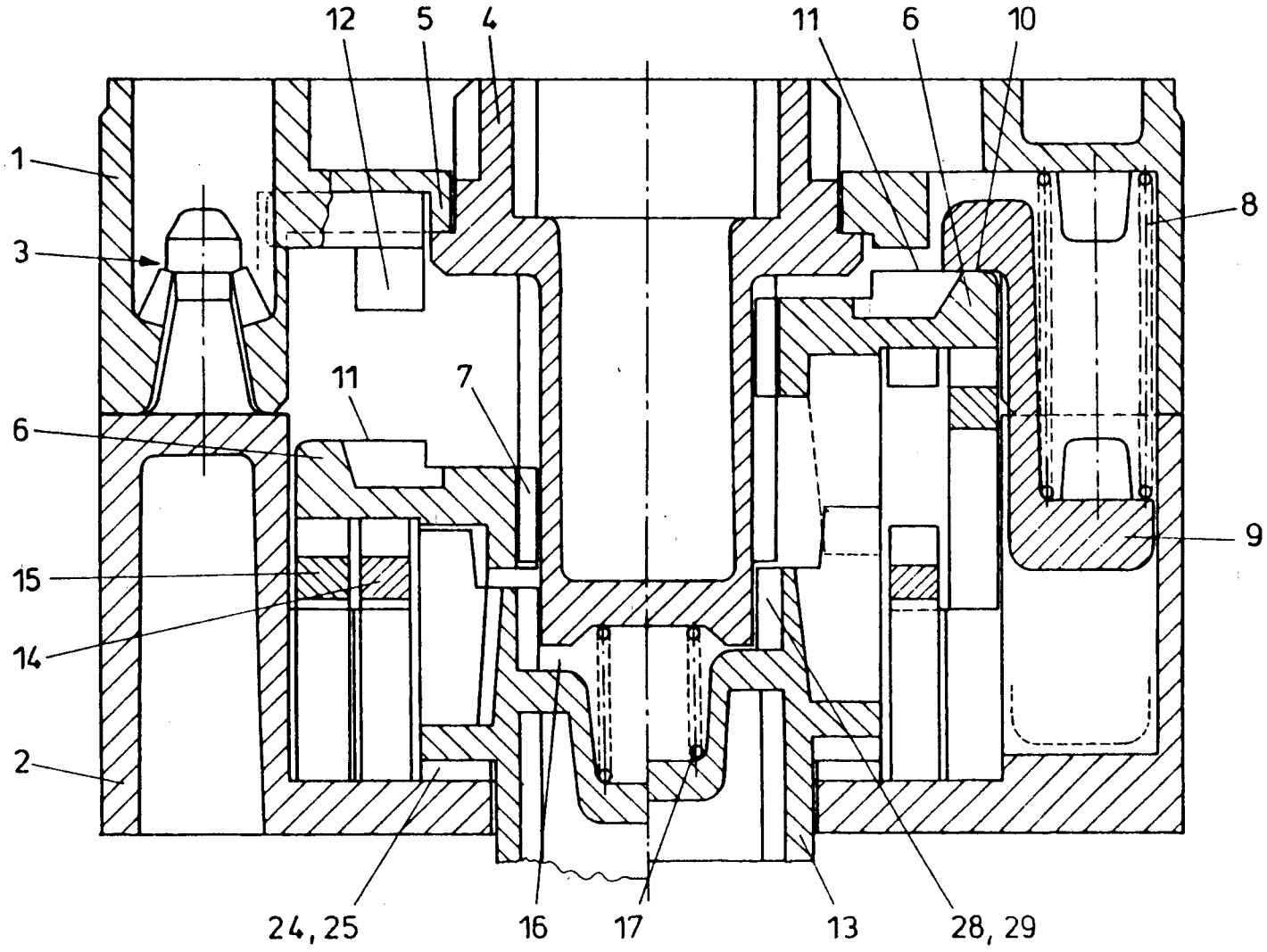

The invention relates to a snap locking mechanism for rotary switches with more than 2 lock-in positions in which the operating shaft can be rotated in a housing by a switch handle against the force of an energy-storage mechanism and the lock-in position is occupied under at least partial tension release of the energy-storage mechanism.

In hand-operated switches the problem constantly arises that the speed with which the movable contacts are disengaged from the stationary contacts depends on the speed with which the operating shaft of the switch is operated. Therefore, with slow operation of the switch, because of the slow separation of the contacts, formation of a very powerful arc can occur, which leads to a considerable reduction of the life of the contacts and possibly also to the destruction of the switch by damaging the part made of insulating material that holds the contacts or burning out of the contact springs.

Therefore, a switch is often required in which the speed of the contact movement is preset by the design and in practice can no longer be affected in the operation. For example this is the case with motor-driven switches but which are expensive and have the drawback of being dependent on a corresponding energy supply and therefore cannot be used for some applications.

A locking mechanism for switches is known from AT-PS 374 960 in which a coupling is provided between an operating shaft, connected to a handle or the like, and an adjusting device controlling the contact operations. An operation-side coupling half torsion-resistant to the operating shaft of this coupling comprises a disk-shaped part with a radial cam formed in the front surface facing away from the handle or the like exhibiting, e.g., elevations inclined 45° toward the two sides, and a lug with smaller diameter, which is overlapped by a hollow cylindrical lug of the output side of the coupling half. This hollow cylindrical lug is surrounded by a spiral spring serving as an energy-storage mechanism, which is introduced under prestress and projects with its ends bent inward in the radial direction into a recess formed in the two lugs. In the rest position of the locking mechanism the side walls of the recess are each aligned in a plane running through the axis of rotation. The output side coupling half has at the end facing away from the operating shaft a hub with external toothing, which guarantees the torsion-resistant slaving of a disk-shaped intermediate ratchet, which on both its fronts exhibits ratchet teeth for opposite directions of rotation. The intermediate ratchet acts to form, on the one hand, a stop device with a ratchet disk held immovable and torsion-resistant in the housing of the locking mechanism and, on the other hand, a ratchet disk held torsion-resistant but axially movable in grooves of the rear housing shell of the locking mechanism and elastically pressed against the output side coupling half. Pins placed axially movable in bores of the output side of the coupling half are used to control the stop device, pins which with one end rest against the radial cam and with the other end against the spring-loaded ratchet disk held nonrotatable and axially movable and further can be brought to rest with shoulders against the intermediate ratchet.

In this type of switches, the design of the energy-storage mechanism as a spiral spring brings certain drawbacks with it, since, on the one hand, the spring coils are to come in contact as little as possible or not at all with the surrounding wall parts of the locking mechanism or switch housing, so that the speed of the contact movement is not influenced in an undesirable way, and on the other hand, the points of application of the spring ends on the allocated parts of the locking mechanism, which for reasons of weight, insulation and corrosion practically always consist of plastic, are critical with respect to the life of the switch.

Another drawback of known rotary switches provided with a locking mechanism was that the operating element could be rotated very quickly over several positions, but the switch element was to be moved by the stop device only by steps. Therefore the stop device had to stop the moment of inertia of the switch and the excessive force of the spring storage in the desired lock-in position. But since the switch requires a well-defined position and must not have any play, the stop device must be able to become operative in the shortest way and be able to absorb great forces. As a result the stop device was often overtaxed.

The object of the invention is to provide a snap locking mechanism of the initially mentioned type in which the speed of the contact movement in the switching process is independent of the operating speed of the operating shaft and of other influences and which exhibits a type of force transmission between the energy-storage mechanism and the allocated parts of the locking mechanism favorable to the service life and in which an unintentional skimming over the lock-in positions by too fast a rotation of the switch handle or an exertion of an excessive moment of inertia on it is avoided.

To achieve this object, the locking mechanism according to the invention consists essentially in that the energy-storage mechanism is formed by at least one axially acting compression spring and acts on a handle-side driver ring exhibiting slopes in the peripheral direction which is coupled torsion-resistant but axially movable with the operating shaft and which interacts with another driver ring, couplable with the operating shaft, exhibiting a corresponding counterprofile with slopes, in that a coupling for dragged slaving is provided between the two driver rings and in that the handle-side driver ring carries stops, which interact with counter-stops, integral with the housing, when they reach the snap position of the locking mechanism.

Since the energy-storage mechanism is formed from at least one axially acting compression spring, great energy can be stored with miniature springs and especially a design is possible in which even a break of a spring does not substantially affect the function of the locking mechanism. Further, the energy-storage mechanism by compression of such a compression spring makes possible designs in which the stored energy is distributed over a substantially larger radius and is made effective over the periphery of the driver ring, which is acted on, and this type of energy absorption is substantially more favorable than the energy that can be absorbed in the case of a flat spiral spring, which is made effective on at least one end of the flat spiral spring always in the vicinity of the axis and thus by an unfavorable lever arm. Because of the axially movable arrangement of the handle-side driver ring coupled torsion-resistant with the operating shaft, the driver ring can be acted on by compression springs forming the energy-storage mechanism, for example, on several positions of the periphery of this driver ring, by which an especially favorable energy absorption occurs with miniature springs. Especially such a design makes possible a protected arrangement of the springs in the wall of the housing of the snap locking mechanism.

The coupling for the dragged slaving between the two driver rings provides for the introduction of the operation of the switch elements when the switch handle is rotated over a considerable part of the way from one lock-in position to the next and the energy-storage mechanism is correspondingly tensioned. By the interaction of the stops of the handle-side driver ring with the counterstops integral with the housing the further rotation of the switch handle on reaching the snap position of the locking mechanism is momentarily blocked and thus an overwinding of the switch handle to the next lock-in position is prevented to the greatest extent possible, since even the person operating the switch feels as a result of the momentary resistance that he has rotated the switch handle far enough for the intended switching process.

Preferably, the stops, integral with the housing, are mounted to be swingable. The type of construction in this case can correspond to a pawl engaging on the outside periphery of the handle-side driver ring. In case of a snap locking mechanism operative in both directions of rotation at least one such pawl is then provided for each direction of rotation.

A favorable embodiment of a snap locking mechanism operative in both directions of rotation consists in the stops of the handle-side driver ring being formed by radial ribs, which interact with stop rockers mounted to be swingable in the housing. The stop rockers can swing around axes radial to the axis of rotation of the locking mechanism and by the radial ribs of the handle-side driver ring in its rotation as a function of the direction of rotation are swung into the respective position necessary for achieving a reliable stop. In the rotation of the handle-side driver ring its radial ribs run against the front of the stop rockers, by which the handle-side driver ring and the switch handle are held until the switching element manually independent has followed this position; then the radial ribs of the handle-side driver ring leave the engagement area of the stop rockers and this driver ring as well as the switch handle are released for a next step. The stop rockers can be placed without substantial volume requirement on the inside front of the housing.

The stop rockers suitably extend in the peripheral direction over a length that is greater than the distance, measured on the same radius, of the radial ribs of the handle-side driver ring. As a result, the stop rockers are brought by the radial ribs in their movement against the force of the energy-storage mechanism into a swing position, which assures a reliable stop for the radial rib following in the direction of rotation.

Preferably, to achieve the coupling for dragged slaving between the two coaxially placed driver rings an outside toothing with narrow teeth in the peripheral direction is placed on the one driver ring, said teeth engaging in the peripheral direction in wide tooth gaps of an inner toothing provided on the other driver ring. In this way, a sturdy free travel connection is achieved without an increase of the axial overall length of the locking mechanism being necessary.

According to a preferred further development of the snap locking mechanism according to the invention the slopes of the handle-side driver ring as well as the slopes of the switch-side driver ring interacting with these slopes are each equally inclined mutually opposite. In such a design, the handle-side rotating forces to be used for storing the energy in the opposite directions of rotation are the same. The slopes of the driver rings interacting with one another are not moved beyond the highest point of the slopes and thus the same surface pairs of the two driver rings come to rest on one another.

With the equipping of a switch with different types of switch elements, such as break contacts, make contacts or changeover contacts, different torque stresses of the switch mechanism occur. By a further development of the snap locking mechanism according to the invention at least for the tensioning of the energy-storage mechanism a relief of the slopes of the driver rings and at the same time an exact stop device can be achieved by at least one annular link being placed concentrically to the slopes of the driver rings, a link which exhibits on its front sawteeth inclined opposite one another running in the peripheral direction and on the side facing toward the handle-side driver ring and on the front facing away from this driver ring interacts respectively with a corresponding counterprofile on the handle-side driver ring or in the housing. By the concentric arrangement of such annular links, again a compact construction is achieved, and the in case of sawteeth with alternately steeper and flatter sides in the case of two permissible directions of rotation, links can be placed correspondingly oriented in the opposite direction, which again can be placed concentric to one another in a space-saving manner.

The design in the case of two permissible directions of rotation in this case is advantageously made so that for each direction of rotation a separate coaxially placed annular link is provided, and the sawteeth of one link exhibit alternately steeper and flatter sides and the flatter or steeper sides of one link run sloped opposite the flatter or steeper sides of the other link. The switching process, i.e., the rotation of the other driver ring couplable with the operating shaft, in this case is triggered by passing the dead-center position of the links rotatable relative to one another and the force stored in the energy-storage mechanism takes effect quickly by the respective steeper of the two sides of the sawtooth of the link and quickly independently of the speed of operation of the switch handle. The switching process itself therefore takes place with substantially uninfluenceable speed and the rotation of the switch handle until the triggering of the switching process serves exclusively for storage of the force necessary for the switching process. The switching process itself in this case takes place advantageously in that the link is rotated by the handle-side driver ring, and the design is advantageously made so that the handle-side driver ring, concentrically to its slopes interacting with the switch-side driver ring, exhibits for each link sawtoothlike profiles for rotation of the respective link(s), which with the use of the respective link serving for the other direction of rotation of the locking mechanism act as a free wheel.

To assure that in the snap locking mechanism according to the invention the operating shaft couplable with the switch element remains at rest during the tensioning of the energy-storage mechanism, and the rotation of the operating shaft, which takes place exclusively with the force stored in the energy-storage mechanism, actually is not used until the energy-storage mechanism has stored at least considerable energy, the design is advantageously made so that the switch-side driver ring on the side facing away from the slopes of the handle-side driver ring is designed with knobs, radial ribs or the like or recesses and/or radial grooves, whose maximum side slope in the peripheral direction relative to a plane perpendicular to the locking mechanism axis is less than 90° and which interact with shapings designed complementary to it. The release of the switch-side driver ring from the shapings takes place by the coupling for the dragged slaving.

The already initially mentioned advantages of the arrangement of the axially operating compression springs can be used especially well in that the energy-storage mechanism is formed by at least three springs placed on the periphery of the housing, springs whose spring retainers engage over the edge of the handle-side and axially movable driver ring on the side facing toward the switch handle, and the arrangement of at least three springs in this case assures that even with one spring breaking a sufficient adjusting energy for the switch is still stored. To increase the symmetry of the force effect even with the breaking of one spring, of course additional springs can correspondingly be placed, which especially because of the miniature compression springs in the housing seems easily possible.

The energy-storage mechanism formed by the compression springs is loaded by the axial movement of the handle-side driver ring in the movement along the flatter sides of a link or along the slopes of the switch-side driver ring, and therefore the springs must be placed so that the spring retainers engage over the edge of the handle-side and axially movable driver ring on the side which is to be acted on in the release of the compression springs to rotate the switch-side driver ring into the new lock-in position. In this connection, to be able to use springs with small diameters, it is desirable to incorporate springs of considerable length, and the design according to the invention with compression springs operating only axially therefore allows in a especially advantageous way a configuration in which the spring retainers are designed as sleeves or bushes axially movable in grooves or bores of the housing. In this way, the springs can extend over almost the entire axial length of the housing and, at the same time, by the movable sleeves or bushes an axial guiding of the compression springs is assured, by which the effect of force in the release of the springs can be kept largely free from friction losses.

Figure 2:
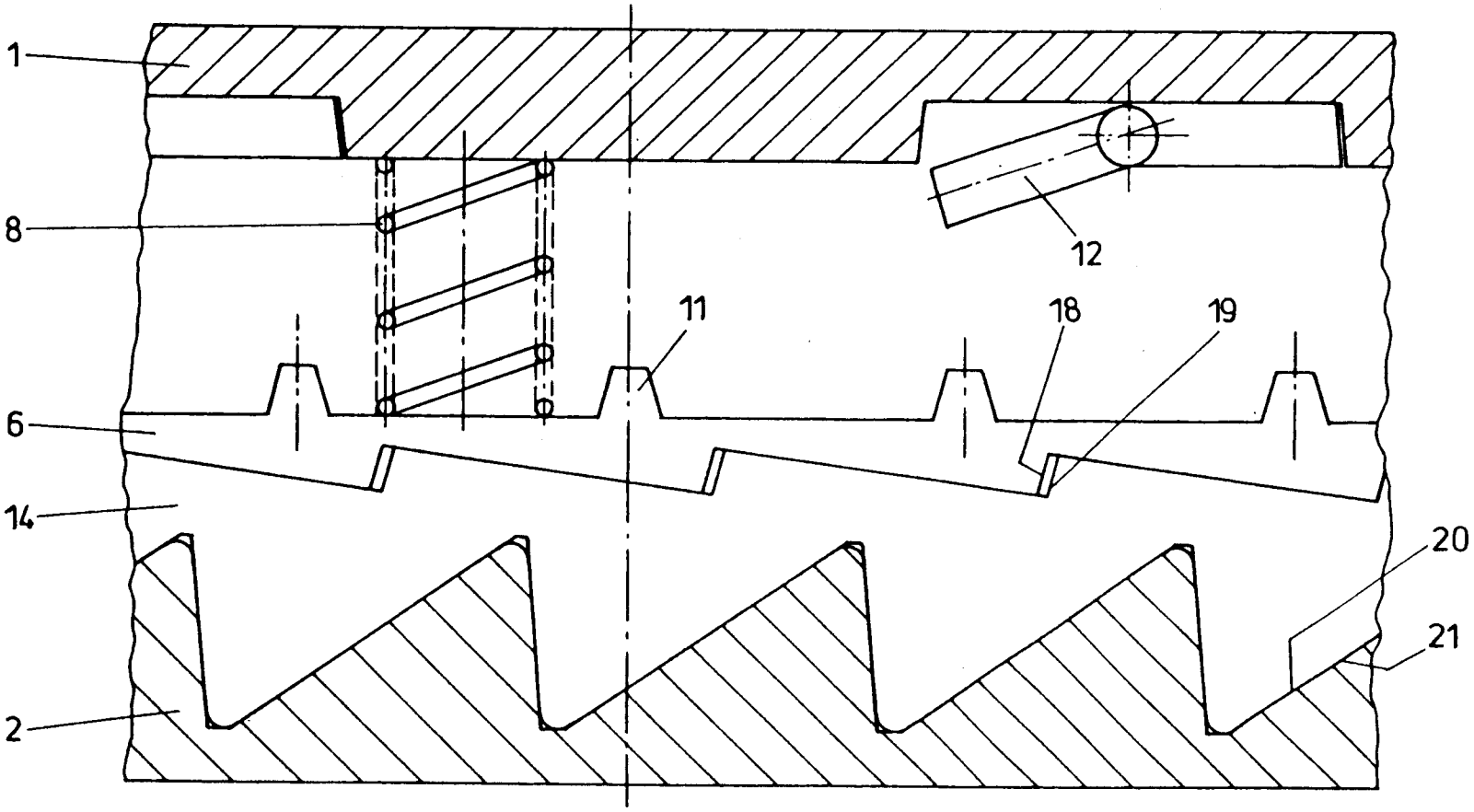
Figure 3:
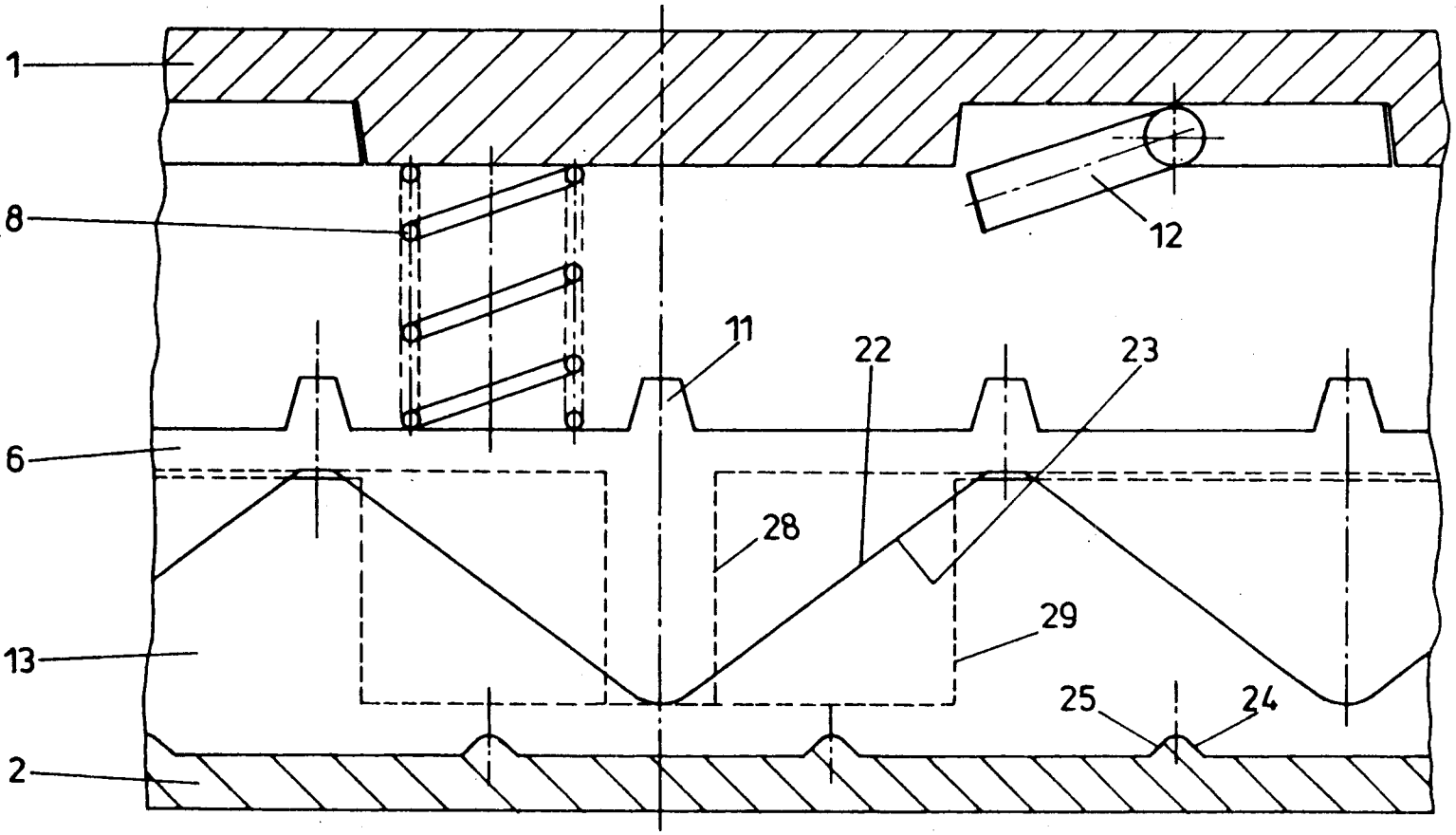
Figure 4:
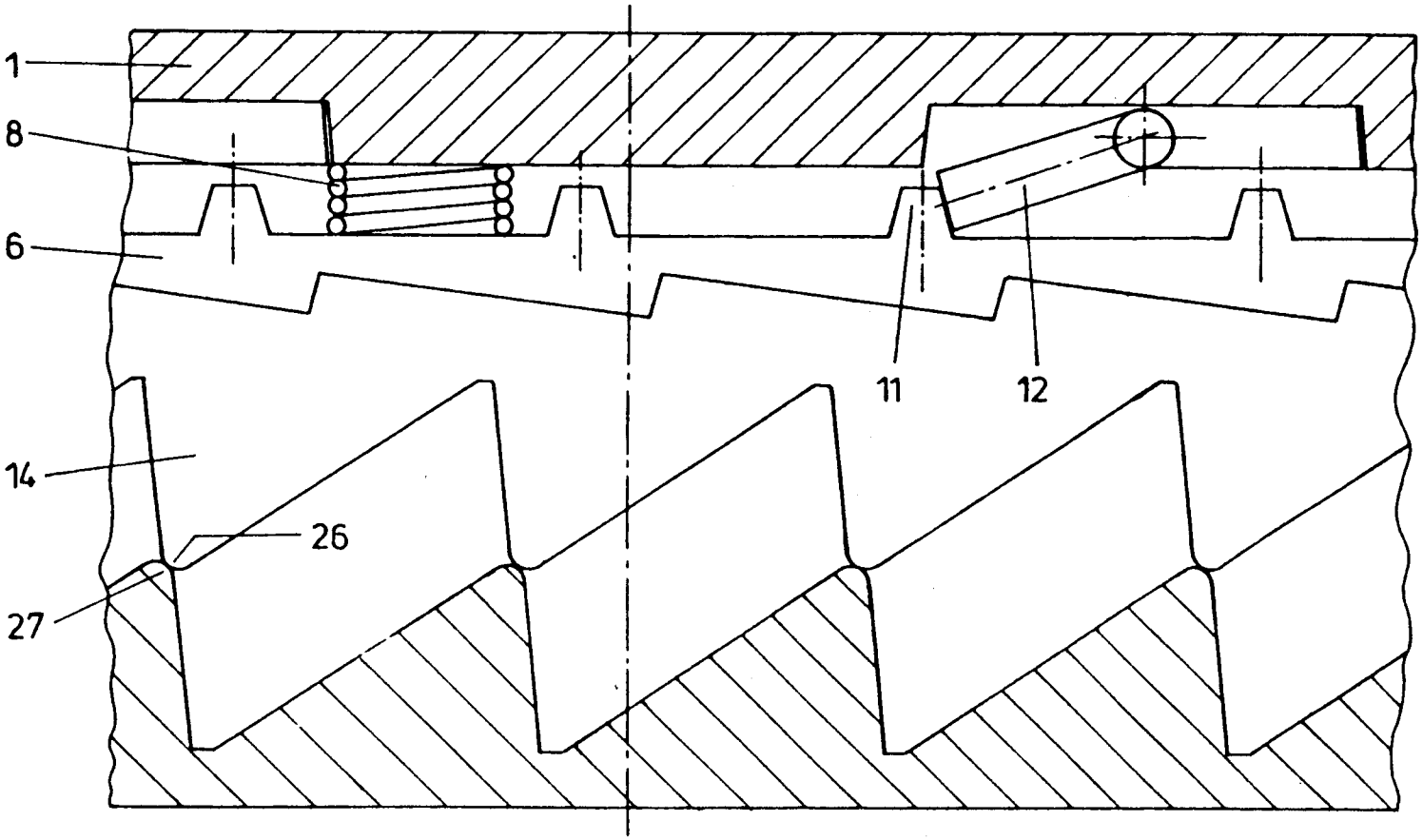
Figure 5:
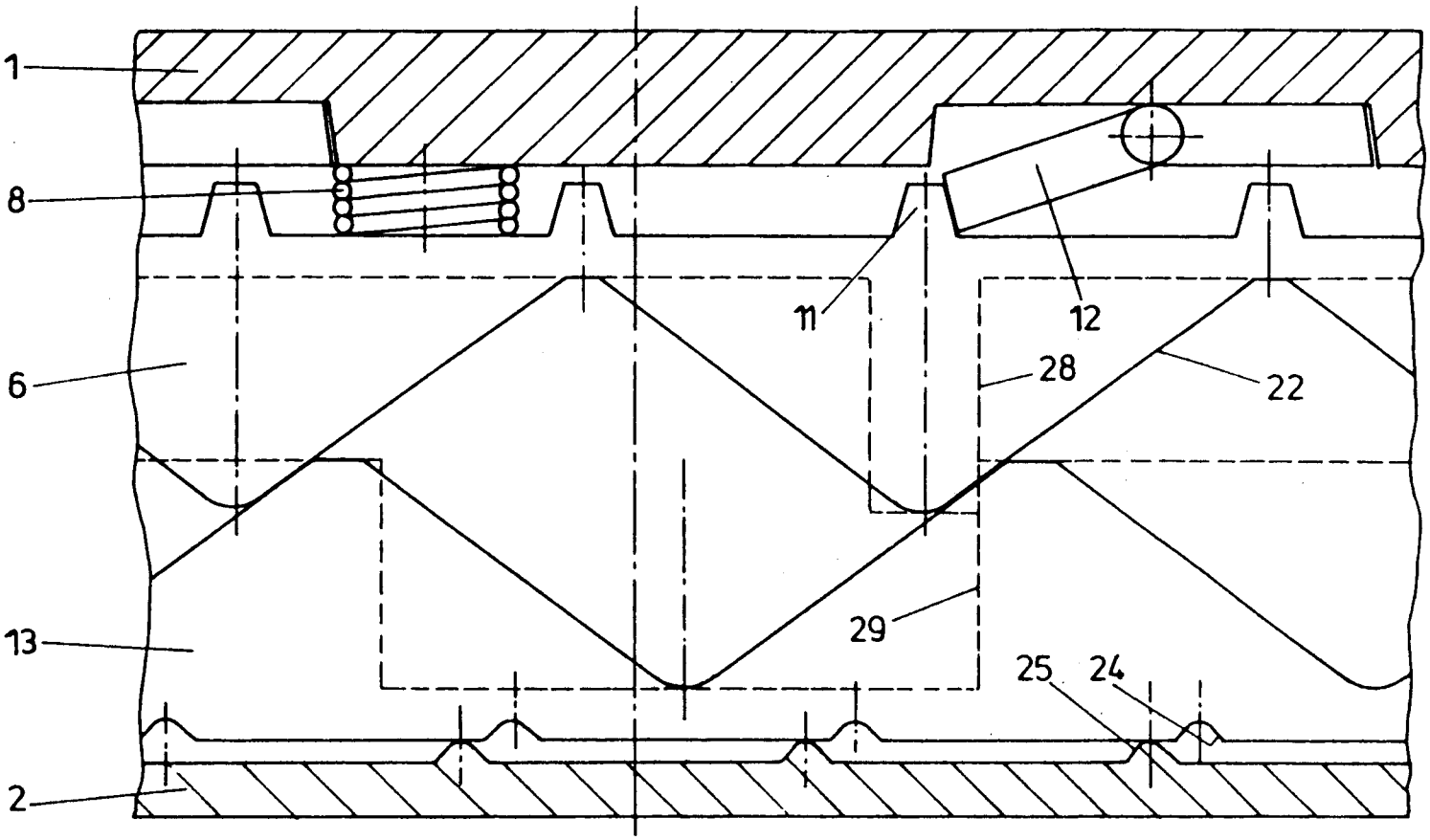

The invention is explained in greater detail below by an embodiment diagrammatically represented in the drawing. In this drawing, there are shown in:

FIG. 1, a snap locking mechanism according to the invention in axial section;

FIG. 2, a part of a developed representation of a link of the snap locking mechanism according to FIG. 1 interacting with the handle-side driver ring and the rear housing part;

FIG. 3, a part of developed representation of the switch-side driver ring interacting with the handle-side driver ring in a position of the snap locking mechanism corresponding to FIG. 2;

FIG. 4, the part represented in FIG. 2 in the tensioned energy-storage mechanism at the moment in which the operation of the switch contacts begins; and FIG. 5 the parts of the snap locking mechanism represented in FIG. 3 in a position of the snap locking mechanism corresponding to FIG. 4.

The switch contacts to be operated and their operating elements to be driven by the switch-side driver ring are not represented in the drawing.

From FIG. 1 it can be seen that the housing of the snap locking mechanism is made up of a front or handle-side housing part 1 and a rear or switch-side housing part 2 by a locking connection 3. A hollow operating shaft 4 can be rotated in any direction by a switch handle (not shown). Operating shaft 4 is secured from falling out of housing 1, 2 by stop shoulder 5 of front housing part 1. A handle-side driver ring 6 is torsion-resistant with operating shaft 4 by a toothing 7, but is coupled axially movable. In the left half of FIG. 1, driver ring 6 is drawn in its rest position, in the right half of FIG. 1 it is represented in its maximum raised position during a switching process.

For the locking mechanism as a snap locking mechanism with a high speed, independent of the operating speed of the switch handle, to bring about the contact movement in a switching process, a energy-storage mechanism is provided with several springs 8 distributed uniformly over the periphery of the housing, and this energy-storage mechanism during most of the way of the switch handle movement from one position to the next is tensioned and only at the end of this way is it released for the contact movement in the switching process. One of springs 8 of the energy-storage mechanism is represented in section in the right half of FIG. 1. In the drawing, the upper end of spring 8 is supported in front housing part 1. The lower end of spring 8 rests on a spring retainer 9 that is Z-shaped in longitudinal section. By the special shaping of spring retainer 9, despite the fact that handle-side driver ring 6 moves up and down in the front area of housing 1, 2, almost the entire inside height available in housing 1, 2 can be used for installation space of springs 8. This makes possible in a simple way the achievement of the necessary spring tension as well as a favorable spring characteristic. Projection 10 of spring retainer 9 remote from lower end of spring 8 engages over the upper edge area of handle-side driver ring 6 and in this way transfers the spring tension to the driver ring. In FIG. 2 to 5 respectively a spring 8 is represented only diagrammatically and not corresponding to the actual design.

On its top handle-side driver ring 6 is provided with radial ribs 11, whose angle division corresponds to the angle division of the switch positions. For interaction with radial ribs 11 of handle-side driver ring 6 stop rockers 12 are mounted to be swingable around radial axes in front housing part 1, and stop rockers 12 extend in the peripheral direction over a length, which is greater than the distance, measured on the same radius, of radial ribs 11 of handle-side driver ring 6, as can be clearly seen in FIGS. 2 to 5.

Within rear housing part 2 operating shaft 4 and a switch-side driver ring 13, interacting with handle-side driver ring 6, are surrounded by two links 14 and 15 placed coaxial with the driver rings, each of which links respectively is operative for one direction of rotation. For this purpose, each link is provided on its front with sawteeth, inclined in the opposite direction to one another, running in the peripheral direction, teeth which alternately exhibit steeper and flatter sides, and the flatter or steeper sides of one link run inclined in the opposite direction to the flatter or steeper sides of the other link. In this way the upper sawteeth interact with the corresponding sawteeth of the handle-side driver ring and the lower sawteeth with great tooth height are in operative connection with corresponding sawteeth formed in rear housing part 2. The interaction of these sawteeth will be explained in greater detail below. Since in the operation of the locking mechanism or of the switch, switch-side driver ring 13 must be able to make small axial movements, a clearance 16 is provided between the mutually facing fronts of operating shaft 4 and swtich-side driver ring 13. Further, a compression spring 17 is inserted between the two fronts.

FIG. 2 shows a development of a cylinder surface running through link 14 and FIG. 3 shows a development of a cylinder surface running through the interacting profiles of the two driver rings, in the rest position of the snap locking mechanism in each case. In the rest position, compression spring 17 presses switch-side driver ring 13 with its front recesses 24 on knobs 25 of rear housing part 2 and locks the switch so that the latter is kept in its position both during vibration or shock and tensioning of the energy-storage mechanism by the operation of handle-side driver ring 6. In case of a switching movement, directed toward the right in the drawing, exerted on handle-side driver ring 6, a torque is transmitted by sides 18 to corresponding sides 19 of link 14 and link 14 slides obliquely forward with its flat sides 20 along corresponding sides 21 of rear housing part 2 and tensions springs 8 forming the energy-storage mechanism. Shortly before the end of the switching movement—before rib 11 of driver ring 6 strikes against stop rocker 12—a narrow tooth or a rib 28 of driver ring 6 comes to lie on side 29 of switch-side driver ring 13 and in the further switching movement the switch-side driver ring is carried by side 29 so far that knobs 25 are moved out of recesses 24 and thus the catch of the switch is lifted. Synchronously with the movement of sides 20 along corresponding sides 21, as shown in FIG. 3, sides 22 of handle-side driver ring 6 move on sides 23 of switch-side driver ring 13.

FIGS. 4 and 5 represent the mutual position of the individual components of the locking mechanism for the moment in which the spring storage is tensioned and the switch-side driver ring begins its manually independent movement. In this position, rib 11 of handle-side driver ring 6 strikes against stop rocker 12 and tips 26 of the sawteeth of link 14 just about skim over tips 27 of the stationary sawteeth on the bottom of rear housing part 2, so that link 14 with its sawteeth can drop into the tooth gaps of the stationary toothing. As a result, the force of springs 8 acts on handle-side driver ring 6 by inclined sides 22 on sides 23 of switch-side driver ring 13 and moves the latter into the next position, to the right in the drawing, until knobs 25 come to lie in recesses 24.

From FIG. 5 it can be seen that slopes 22 of handle-side driver ring 6, as before, interact with the same slopes 23 of switch-side driver ring 13 and never pass one another with their highest elevations, but under the energy action of springs 8 reslide into their original relative position, (see FIG. 3), and also switch-side driver ring 13 cannot run beyond this initial position, since for this purpose springs 8 would have to be retensioned.

Only if the force of springs 8 is sufficient to move switch-side driver ring 13, do ribs 11 of handle-side driver ring 6 come free and the next switching movement can be started. If the force of springs 8 is not sufficient to move switch-side driver ring 13, and no torque is any longer exerted on the operating element, handle-side driver ring 6 is moved back into the initial position by sides 22 and 23, and thus the operating element, which more often than not is provided with an indicating device, again indicates the position corresponding to switch-side driver ring 13.

From FIGS. 2 to 5 it can be seen that, since the length of stop rocker 12, measured over both arms, is greater than the distance of two consecutive ribs 11 of handle-side driver ring 6, as a function of the direction of rotation of handle-side driver ring 6 automatically brings about the correct position of stop rockers 12, since before the possibility of striking a rib 11 on a front end of stop rocker 12 a leading rib 11 presses the other arm of stop rocker 12 into the corresponding recess of front housing part 1. For the other direction of rotation, then other link 15 (not represented in FIGS. 2 and 4) is used, whose sawtooth sides relative to link 14 are correspondingly designed the opposite direction.

I claim:

1. A snap locking mechanism for rotary switches with more than two lock-in positions, including a stationary housing, an operating shaft, and at least one compression spring energy storage mechanism, said lacking mechanism having snap positions; said compression spring energy storage mechanism acting on a first driver ring having a periphery, said first driver ring exhibiting slopes along the periphery, said first driver ring interacting with another, second, driver ring, couplable with the operating shaft, exhibiting a corresponding counterprofile with slopes; and a coupling for dragged slaving between the two driver rings and; said first driver ring carrying stops, which interact with counterstops integral with the housing, when said stops reach the snap position of the locking mechanism, to temporarily block further rotation of said operating shaft and thus prevent an overwinding of said mechanism to the next lock-in position.

2. Snap locking mechanism according to claim 1, wherein counterstops, integral with the housing, are mounted to be swingable.

3. Snap locking mechanism according to claim 1, wherein said countersteps are stop rockers, and wherein said stops of said first driver ring are formed by radial ribs, which interact with said stop rockers mounted to be swingable in the housing.

4. Snap locking mechanism according to claim 3, wherein stop rockers extend along said periphery over a length that is greater than the distance, measured on the same radius, of the stops of said first driver ring.

5. Snap locking mechanism according to claim 1, wherein to achieve the coupling for dragged slaving between the two coaxially placed driver rings an outside toothing with narrow teeth is provided on said just driver ring, said teeth engaging in wide tooth gaps, of an inner toothing provided on the second driver ring.

6. Snap locking mechanism according to claim 1, wherein at least one annular link is placed concentrically to slopes of said driver rings, said link having a periphery, and a front surface with sawteeth inclined in opposite direction to one another running along and on a side facing toward said first driver ring and on a surface facing away from said first driver ring, said link interacts respectively with a corresponding counterprofile on said first driver ring in housing.

7. Snap locking mechanism according to claim 6, wherein for each direction of rotation a separate coaxially placed annular link is provided, and the sawteeth of one link exhibit alternately steeper and flatter sides and the flatter or steeper sides of one link run sloped opposite the flatter or steeper sides of the other link.

8. Snap locking mechanism according to claim 1, wherein said second driver ring on a side thereof facing away from the slopes of said first driver ring, has surface manifestations, whose maximum side slope relative to a plane perpendicular to the locking mechanism axis is less than 90° and which interact with corresponding surface manifestations of said housing which are complementary thereto.

9. Snap locking mechanism according to claim 1, wherein the energy-storage mechanism is formed by at least three springs placed around said housing, and said springs having spring retainers which engage an edge of said first driver ring.

10. A snap locking mechanism for rotary switches having more than two lock-in positions, comprising:

a stationary housing;

a rotatable operating shaft, rotatable about an axis of rotation;

at least one axially acting compression spring;

a first driver ring, having a first portion with peaks and valleys around a periphery thereof, said first driver ring operatively connected to said shaft;

a stationary element, mounted to said housing and stationary with respect to said housing, having peaks and valleys for cooperation with the peaks and valleys of said first driver ring first portion;

said peaks and valleys of said driver ring and stationary element cooperating to define said more than two lock-in positions, the peaks of said ring are received by the valleys of said stationary element in each lock-in position;

said at least one compression spring biasing said first ring into contact with said stationary element; and means for effecting momentary arrest of said first driver ring in each lock-in position so that quick rotation of said shaft does not result in overtravel of said first driver ring with respect to said stationary element and thereby skipping of a lock-in position is avoided; said means comprising a series of stop projections on said first driver ring opposite said peaks and valleys of said first portion thereof, and stops mounted on said on said housing for momentary cooperation with said stop projections when said first driver ring moves axially to compress said at least one compression spring.

11. A mechanism as recited in claim 10, wherein said stops on said housing are mounted for pivotal movement about an axis generally perpendicular to the axis of rotation of said shaft.

12. A mechanism as recited in claim 10 further comprising a second driver ring and a second portion of said first driver ring, said second portion of said first driver ring and said second driver ring having cooperating peaks and valleys so that relative rotation of one with respect to the other effects axial movement of said first driver ring, to compress said at least one compression spring.

13. A mechanism as recited in claim 12 wherein said housing has a periphery, and wherein said at least one compression spring comprises three compression springs disposed substantially equally around the periphery of said housing in operative association with said first driving ring.

14. A mechanism as recited in claim 13 wherein said stops on said housing are mounted for pivotal movement about an axis generally perpendicular to the axis of rotation of said shaft.

15. A mechanism as recited in claim 13 wherein each of said springs is provided in a spring retainer having a bottom portion engaging a spring, and a top portion engaging a top surface of said first driver ring.

16. A snap locking mechanism for rotary switches with more than two lock-in positions, including a stationary housing, an operating shaft, and at least one compression spring, said mechanism having snap positions; said compression spring acting on a first driver ring, having a periphery, exhibiting slopes along said periphery, said first driver ring interacting with a second driver ring, couplable with the operating shaft, exhibiting a corresponding counterprofile with slopes; and a coupling for dragged slaving between the two driver rings; said first driver ring carrying stops which interact with swingably mounted counterstops on said housing, when said stops reach the snap position of the locking mechanism.

17. Snap locking mechanism according to claim 16, wherein for each direction of rotation a separate coaxially placed annular link having sawteeth is provided, and the sawteeth of one link exhibit alternately steeper and flatter sides and the flatter or steeper sides of one link run sloped opposite the flatter or steeper sides of the other link.

* * * * *